US010927481B2

(12) United States Patent
Hagl et al.

(10) Patent No.: US 10,927,481 B2
(45) Date of Patent: Feb. 23, 2021

(54) TRAVERSING UNIT, METHOD FOR OPERATING A TRAVERSING UNIT, AND WORKSTATION COMPRISING A TRAVERSING UNIT

(71) Applicant: Maschinenfabrik Rieter AG, Winterthur (CH)

(72) Inventors: Robert Hagl, Rottenegg (DE); Thomas Gruber, Ingolstadt (DE); Andreas Hoyer, Mainburg (DE); Bernd Bahlmann, Schrobenhausen (DE)

(73) Assignee: Maschinenfabrik Riefer AG, Winterthur (CH)

( * ) Notice: Subject to any disclaimer, the term of this patent is extended or adjusted under 35 U.S.C. 154(b) by 198 days.

(21) Appl. No.: 16/170,086

(22) Filed: Oct. 25, 2018

(65) Prior Publication Data

US 2019/0119063 A1 Apr. 25, 2019

(30) Foreign Application Priority Data

Oct. 25, 2017 (DE) ..... 10 2017 124 983.4

(51) Int. Cl.
*D01H 13/06* (2006.01)
*B65H 57/28* (2006.01)
*B65H 51/10* (2006.01)

(52) U.S. Cl.
CPC ..... *D01H 13/06* (2013.01); *B65H 51/10* (2013.01); *B65H 57/28* (2013.01); *B65H 2701/31* (2013.01)

(58) Field of Classification Search
CPC ..... B65H 7/28; B65H 51/10; D01H 13/06
See application file for complete search history.

(56) References Cited

U.S. PATENT DOCUMENTS 2,178,442 A * 10/1939 Torbet ..... B65H 63/061 28/223
2,264,424 A * 12/1941 Winslow ..... B65H 54/38 242/477.6
2,388,557 A * 11/1945 Little ..... B65H 54/2809 242/477.3

(Continued)

FOREIGN PATENT DOCUMENTS

CZ 294639 B6 2/2005
DE 2 118 217 10/1971

(Continued)

OTHER PUBLICATIONS

German Patent Office Search Report, dated May 30, 2018.
EPO Search Report, dated Mar. 27, 2019.

*Primary Examiner* — Shaun R Hurley
(74) *Attorney, Agent, or Firm* — Dority & Manning, P.A.

(57) ABSTRACT

A traversing unit for traversing a yarn with respect to a pair of delivery rollers of a workstation of a textile machine includes a yarn-guiding unit, a single traversing drive configured with the yarn-guiding unit, and a conversion element configured with the single traversing drive such a rotational movement (ω) of the single traversing drive is converted into a linear, reciprocating movement of the yarn-guiding unit. The single traversing drive is a rotating motor. A sensor is disposed to detect at least a middle position of the yarn-guiding unit.

14 Claims, 2 Drawing Sheets

(56) References Cited

U.S. PATENT DOCUMENTS 3,624,798 A * 11/1971 Fleischer ..... A01K 89/01915 242/277
3,801,030 A 4/1974 Kobatake et al.
4,049,211 A * 9/1977 Spescha ..... B65H 54/383 242/413.9
4,078,372 A * 3/1978 Stahlecker ..... D01H 4/00 242/157.1
4,102,507 A 7/1978 Hoffmann et al.
4,881,694 A * 11/1989 Bartkowiak ..... B65H 54/2812 242/477.1
5,370,325 A * 12/1994 Borer ..... B65H 54/2815 242/476.8
5,630,449 A * 5/1997 Ammann ..... D03D 49/60 139/145
5,762,277 A * 6/1998 Uedinger ..... B65H 54/2812 242/157.1
5,927,638 A * 7/1999 Stahlecker ..... B65H 54/2809 242/482.8
5,974,989 A * 11/1999 Liu ..... D05B 23/00 112/1
6,027,065 A * 2/2000 Stahlecker ..... B65H 54/2809 242/482.8
6,405,966 B1 6/2002 Lieber et al.
6,463,978 B2 * 10/2002 Mayet ..... B29D 30/10 156/117
6,978,962 B1 * 12/2005 Fore, Sr. ..... B65H 67/052 226/151
7,217,108 B2 * 5/2007 Herwig ..... F04B 43/082 417/474
2001/0042808 A1 * 11/2001 Klaus ..... B65H 54/2827 242/483.8
2004/0021031 A1 * 2/2004 Klaus ..... B65H 54/2884 242/483.8

FOREIGN PATENT DOCUMENTS

DE 2 133 172 1/1972
DE 25 41 761 3/1977
DE 299 09 105 U1 7/1999
DE 101 14 368 A1 10/2001
DE 10 2006 004 894 A1 8/2007
DE 11 2007 001 233 B4 4/2014
EP 1 785 513 A2 5/2007
GB 1 350 267 4/1974
JP H 08 291429 A 11/1996
WO WO 2007/134555 A2 11/2007

* cited by examiner

TRAVERSING UNIT, METHOD FOR OPERATING A TRAVERSING UNIT, AND WORKSTATION COMPRISING A TRAVERSING UNIT

FIELD OF THE INVENTION

The present invention relates to a traversing unit for traversing a yarn with respect to a pair of delivery rollers of a workstation of a textile machine. The traversing unit including a yarn-guiding unit, a single traversing drive for driving the yarn-guiding unit, and a conversion element, with the aid of which a rotational movement of the single traversing drive is converted into a linear, reciprocating movement of the yarn-guiding unit. The invention also relates to a workstation comprising the traversing unit, and to a method for operating the traversing unit.

BACKGROUND

DE 10 2006 004 894 A1 describes an auxiliary thread guide for traversing a moving thread in the area of a thread draw-off unit of a textile machine producing cross-wound bobbins. The auxiliary thread guide is connected to a reversibly operable single drive. The single drive is designed as a stepper motor, and so the position and the spacing of the reversal points can be adjusted in a defined manner by controlling the stepper motor accordingly. The disadvantage thereof is that the reversibly operable single drive must be driven in a complicated manner for the traversing of the thread.

SUMMARY OF THE INVENTION

A problem addressed by the present invention is therefore that of resolving the disadvantage of the related art. Additional objects and advantages of the invention will be set forth in part in the following description, or may be obvious from the description, or may be learned through practice of the invention.

The problems are solved by a traversing unit, a method for operating the traversing unit, and a workstation comprising the traversing unit having the features described and claimed herein.

The invention relates to a traversing unit for traversing a yarn with respect to a pair of delivery rollers of a workstation of a textile machine. The traversing unit comprises a yarn-guiding unit which transmits a traversing movement onto the yarn. The traversing unit further comprises a single traversing drive, with the aid of which the yarn-guiding unit is driven. The traversing unit also comprises a conversion element, with the aid of which a rotational movement of the single traversing drive is converted into a linear, reciprocating movement of the yarn-guiding unit. The linear, reciprocating movement is the traverse or the traversing movement which is transmitted onto the yarn. Due to the traversing of the yarn, the pair of delivery rollers is acted upon across a wide range by the yarn extending between the delivery rollers, thereby preventing the yarn from cutting into the lateral faces of the delivery rollers.

According to the invention, the single traversing drive is designed as a rotating motor. The rotating motor can be a so-called rotary-type unit which can be operated in only one direction of rotation or which has only one running direction. As a result, the single traversing drive can be more favorably designed as compared to a reversing motor which rotates in both directions. In addition, the rotating motor is also substantially less susceptible to interference than a reversing motor, and so the traversing unit is operated economically. In addition, the control of the single traversing drive is simplified as a result, since the single traversing drive needs only to carry out a permanently rotating movement. The position of the reversal points is established with the aid of the conversion element in this case.

In addition, at least a middle position of the yarn-guiding unit can be detected with the aid of a sensor. The middle position may be, for example, a position centered to the delivery rollers. As a result, it can be detected whether the yarn-guiding unit is positioned correctly with respect to the delivery rollers, so that a uniform wear can occur across the width of the delivery rollers. The middle position may also be the position, however, at which the yarn emerges from the workstation, in particular, from a draw-off tube. This exit point of the yarn is generally positioned in the center at the workstation. As a result, it can be determined, for example, when a yarn end is to be reinserted into the draw-off tube after a yarn break has occurred, whether the yarn-guiding unit is located in the middle position and, therefore, directly over the draw-off tube. As a result, the insertion is facilitated, and therefore, as a result, there is no need to pay attention to a lateral offset between the yarn-guiding unit and the draw-off tube.

In one advantageous embodiment of the invention, the conversion element includes an eccentric element that cooperates with at least one guide element. The eccentric element can be an eccentric disk, for example. The guide element can be designed, for example, as a slot, in which the eccentric element is rotatably mounted. The guide element may be provided, for example, on the yarn-guiding unit. The rotation of the eccentric element moves the guide element linearly back and forth and thereby generates the traversing movement. Due to the eccentric element and the guide element, the rotation of the single traversing drive in one direction is converted into a linear reciprocating movement. The guide element is preferably arranged directly on the movable yarn-guiding unit.

It is also advantageous when the guide element of the yarn-guiding unit has two guide edges, between which the eccentric element is guided. The guide edges may be oriented, for example, in parallel to one other. Due to the rotation of the eccentric element between the two preferably parallel guide edges, the guide edges can be pushed back and forth in an axial direction of the delivery rollers, and so the yarn-guiding unit can be displaced in the axial direction.

Moreover, it is advantageous when the sensor is situated adjacent to the conversion element, in particular, the eccentric element. As a result, the sensor is capable, for example, of detecting which side of the eccentric element is facing the sensor. If the eccentric element is situated, for example, in such a way that the thick, bulbous side of the eccentric element faces the sensor when the yarn-guiding unit is in the middle position, the sensor can detect the middle position on the basis thereof.

It is also advantageous when the sensor is a Hall sensor. Additionally or alternatively, the conversion element may also include a magnetic element that is detected by the sensor, in particular, the Hall sensor. The magnetic element may be situated directly on the eccentric element. If the magnetic element is situated on the conversion element, the magnetic field of the magnetic element is detected when the conversion element or the eccentric element rotates past the Hall sensor. As a result, the orientation of the conversion element can be detected. One advantage of the Hall sensor is that the orientation or position of the conversion element and/or of the eccentric element can be contactlessly detected.

Moreover, it is advantageous if the yarn-guiding unit includes a cutting unit, with the aid of which the yarn is cut in two. When, for example, the workstation is to be stopped or there is a defect in the yarn, the yarn can be cut in two in order to obtain a defined yarn end or to remove the yarn defect. Additionally or alternatively, the yarn-guiding unit may also comprise a blowing unit, with the aid of which a yarn end can be blown into the workstation. The yarn can be pieced back onto the yarn end, and so, for example, a spinning process can be continued. The cutting unit and the yarn-guiding unit may also be formed together as a cutting/blowing unit, and so the traversing unit is designed to be more compact.

It is advantageous if the yarn-guiding unit includes a measuring unit, with the aid of which a condition of the yarn is detected. The measuring unit can detect, for example, the aforementioned yarn defects. The yarn quality is increased due to the measuring unit. Moreover, the measuring unit can be installed downstream from the cutting and/or blowing unit in the flow direction of the yarn. As a result, for example, the blowing unit does not need to blow the yarn through the measuring unit during the yarn piecing. Rather, the blowing unit can convey the yarn directly back into the workstation.

It is also advantageous when the single traversing drive is fixedly situated at the workstation and the at least one guide element is displaceable with respect to the workstation with the aid of the eccentric element. In general, the single traversing drive has a greater weight than the at least one guide element, and so the moving masses can be kept low given a fixed traversing drive and a displaceable guide element. As a result, the energy consumption of the single traversing drive is also kept low. In principle, it would also be conceivable, however, to situate the single traversing drive so as to be displaceable with the yarn-guiding unit and to provide the guide element so as to be fixed at the workstation.

Advantageously, the sensor and/or the conversion element are/is situated on the traversing unit in such a way that aligned position of the yarn-guiding unit with respect to an draw-off tube of the workstation is detectable. Due to the aligned position of the traversing unit with respect to the draw-off tube, the blowing unit can more easily blow the yarn end into the draw-off tube.

Moreover, a workstation comprising a traversing unit is provided. The traversing unit is designed, in this case, according to one or several of the features described in the preceding and/or the following description(s).

Furthermore, a method for operating a traversing unit of a workstation of a textile machine is provided. The traversing unit can be designed, in this case, according to one or several of the features described in the preceding and/or the following description(s).

In the method, a moving yarn is guided in a yarn-guiding unit of the traversing unit. The yarn-guiding unit is moved linearly back and forth with the aid of a single traversing drive and a conversion element in order to traverse the yarn with respect to a pair of delivery rollers of the workstation. The linear reciprocating movement is referred to as a traversing movement. The yarn which is located between two rollers of the pair of delivery rollers during draw-off is thereby moved back and forth in the axial direction of the rollers or perpendicularly to its draw-off direction. As a result, uniform wear of the delivery rollers is achieved and it is ensured that the yarn does not cut into the delivery rollers at a point.

The single traversing drive may be operated as a rotating motor. The rotating motor can be designed, for example, as a rotary-type motor. The rotating motor rotates in only one direction of rotation, and so this motor can be more favorably and simply designed than a motor which rotates in both directions of rotation. In addition, the rotating motor which rotates in only one direction can be more easily controlled than a motor which rotates in both directions in an alternating manner in order to bring about the change in direction during the traversing movement.

In addition, in the method, at least a middle position of the yarn-guiding unit is detected with the aid of a sensor. As a result, it can be detected whether the yarn is aligned with a middle position of the workstation.

In one advantageous embodiment of the invention, during an interruption of the moving yarn, the yarn-guiding unit is positioned at the workstation in such a way that the yarn-guiding unit is aligned with the draw-off tube of the workstation. As a result, a yarn end formed during the interruption can be blown into the draw-off tube and a piecing process can be started, in order to restart the production of the yarn. Preferably, the middle position of the yarn-guiding unit is also the position in which the yarn or the center of the yarn-guiding unit is aligned with the draw-off tube of the workstation. As a result, when a yarn break has occurred, a re-piecing of the yarn can be facilitated, since there is no need to pay attention to a lateral offset between the yarn-guiding unit and the draw-off tube.

It is also advantageous when a position of the conversion element is detected with the aid of the sensor in order to position the yarn-guiding unit on the workstation. As a result, the sensor, which is preferably designed as a Hall sensor, can be situated in the area of the conversion element, so as to simplifying the design of the traversing unit.

According to yet another embodiment of the invention, it is advantageous when a speed profile is predefined for the single traversing drive and the single traversing drive is driven according to the predefined speed profile. In this case, it is advantageous, in turn, when the speed profile is predefined for one full revolution and the single traversing drive follows the speed profile during every revolution. If the speed of the drive is varied, in this case, in such a way that the dwell time of the yarn is approximately identical at every point of the line of contact between the two rollers of the pair of delivery rollers, a highly uniform wear of the pair of delivery rollers, in particular, of the pressure roller of the pair of delivery rollers, can be achieved.

BRIEF DESCRIPTION OF THE DRAWINGS

Further advantages of the invention are described in the following exemplary embodiments. Wherein.

DETAILED DESCRIPTION

Figure 1:
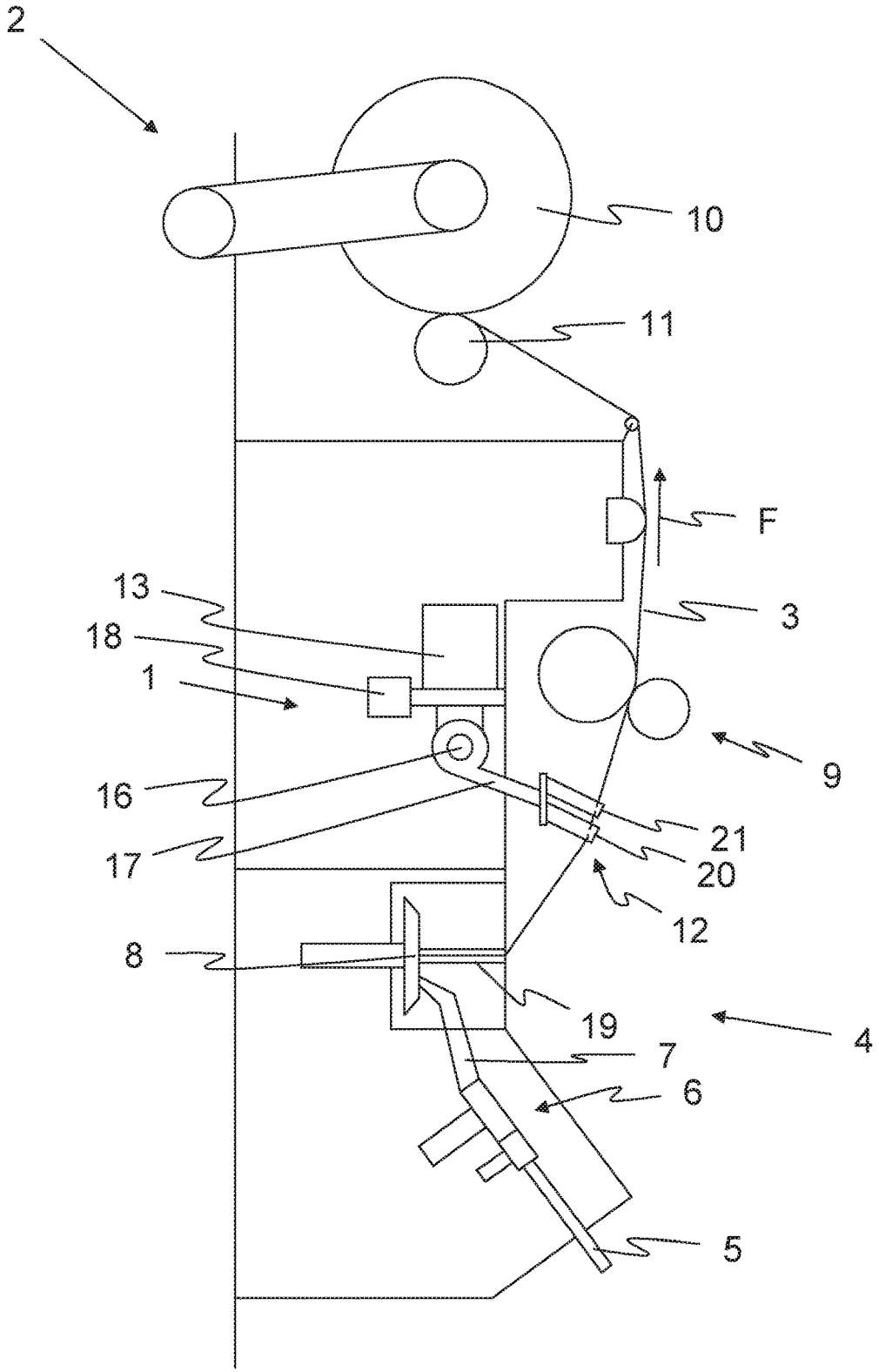
FIG. 1 shows a schematic side view of a workstation comprising a traversing unit.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic side view of a workstation 2 of a textile machine comprising a traversing unit 1. In the workstation 2, a yarn 3 is delivered by a delivery unit 4 and is wound onto a bobbin 10. In the exemplary embodiment shown here, the yarn 3 is formed by the delivery unit 4. In this exemplary embodiment, the delivery unit 4 is a rotor spinning unit, although it could also be an air-jet spinning unit, any other type of spinning unit, or a delivery bobbin of a winder.

For the purpose of forming the yarn 3, the delivery unit 4 includes an opening unit 6 that forms individual fibers 7 from a sliver 5. The fibers 7 are guided into a rotor 8 which produces the yarn 3. The yarn 3 is drawn-off of an draw-off tube 19 of the delivery unit 4 with the aid of a pair of delivery rollers 9. Finally, the yarn 3 is wound onto the bobbin 10. The bobbin 10 is driven by a winding roller 11.

In order to prevent the yarn 3 from cutting into the pair of delivery rollers 9, the yarn 3 can be traversed with the aid of the traversing unit 1. As a result, the yarn 3 is in contact in a wider area with the lateral faces of the delivery rollers of the pair of delivery rollers 9 while it is being drawn-off, thereby preventing the cutting-in.

The traversing unit 1 includes a single traversing drive 13 that drives a yarn-guiding unit 12. In this exemplary embodiment, the yarn-guiding unit 12 is displaceable on a guide 16 in an axial direction X (see FIG. 2; not apparent here) of the pair of delivery rollers 9 with the aid of a holder 17. In this case, the yarn-guiding unit 12 is also connected to a cutting/blowing unit 20 and a measuring unit 21. The measuring unit 21 is installed downstream from the cutting/blowing unit 20 in the flow direction F of the yarn 3, according to FIG. 1. The yarn quality can be monitored with the aid of the measuring unit 21 and yarn defects can be detected with the aid of the measuring unit 21. Moreover, the traversing unit 1 includes a sensor 18.

Due to the displacement of the yarn-guiding unit 12 along the axial direction X of the pair of delivery rollers 9, a linear reciprocating movement (a traversing movement C), is formed, with the aid of which the cutting-in by the yarn is prevented. The traversing movement C is oriented perpendicularly to the plane of the drawing in FIG. 1 and, therefore, is not labeled.

Figure 2:
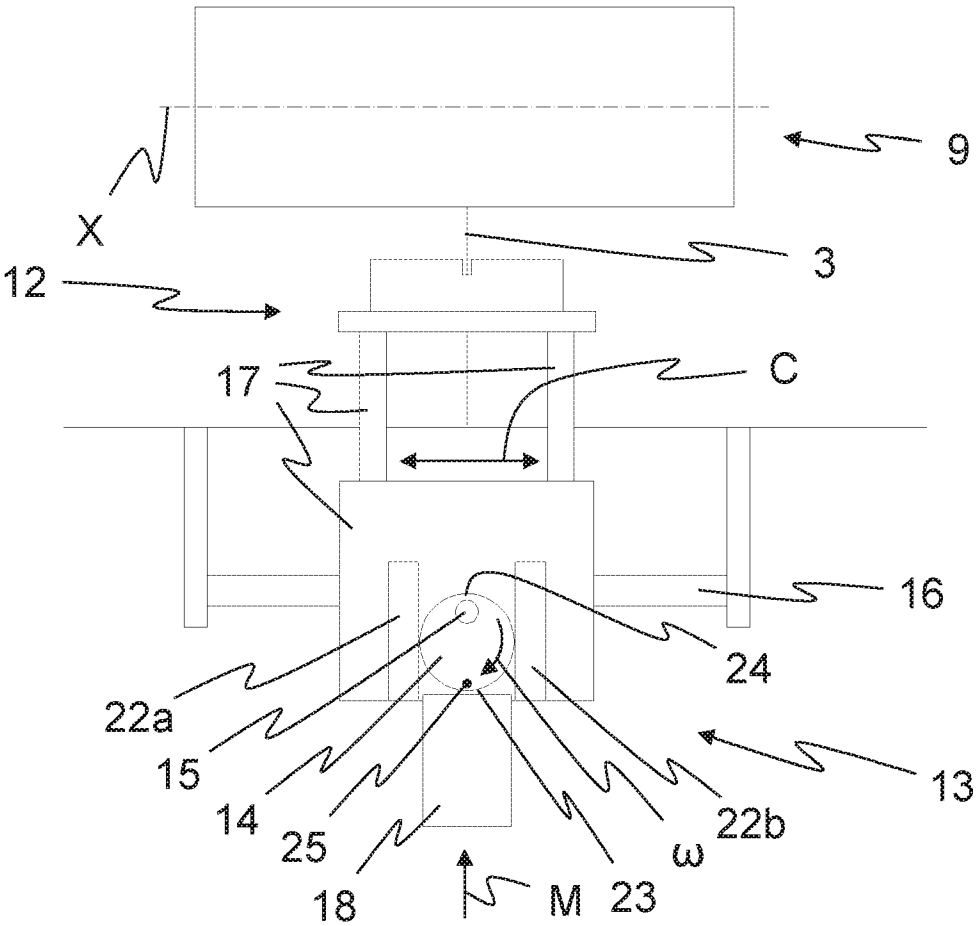
FIG. 2 shows a top view of section of the traversing unit.

The mode of operation of the traversing unit 1 is now described in conjunction with FIG. 2 which shows a top view of a section of the traversing unit 1. The traversing unit 1 includes not only the components already described with reference to FIG. 1, but also a conversion element 14, with the aid of which a rotational movement ω of the single traversing drive 13 is converted into the linear reciprocating movement or traversing movement C.

The single traversing drive 13 is designed as a rotating motor. These types of rotating motors are also known as rotary-type motors and, in contrast to reversing motors, have only one direction of rotation, which is the direction of rotation ω in the present exemplary embodiment. As a result, the single traversing drive 13 can be more simply designed and controlled. A reversal of the direction of rotation of the single traversing drive 13 is therefore not necessary when the traversing movement C is to be reversed.

With the aid of the sensor 18, a middle position M of the yarn-guiding unit 12 can be detected, whereby it can be detected, for example, whether the yarn-guiding unit 12 is aligned with the rotor 8 or with the draw-off tube 19. In this case, the middle position M of the yarn-guiding unit 12 is the position in which the yarn-guiding unit 12 is aligned with the draw-off tube 19. As a result, if a yarn break occurs, the yarn-guiding unit 12 can be moved to the middle position M and, therefore, in alignment with the draw-off tube 19. The piecing or splicing of the yarn is facilitated as a result, since the yarn end is located in a defined position with respect to the delivery unit 4, from which the yarn end can be returned into the delivery unit, namely the draw-off tube 19 in this case.

The yarn-guiding unit 12 can advantageously include a cutting unit and/or a blowing unit, as has already been described with reference to FIG. 1. In this exemplary embodiment, these two units are combined to form a cutting/blowing unit 20. With the aid of the cutting unit of the cutting/blowing unit 20, the yarn 3 can be cut in two, for example, when the supply of the yarn 3 is halted, in order to obtain a defined yarn end. In addition, a yarn defect can be removed with the aid of the cutting unit. With the aid of the blowing unit of the cutting/blowing unit 20, the yarn end and/or the yarn 3 can be blown into the draw-off tube 19 or into the rotor 8. It is important for this reason as well that the cutting/blowing unit 20 of the yarn-guiding unit 12 is aligned with the draw-off tube 19. The blowing-in of the yarn 3 is simplified as a result.

Moreover, the conversion element 14 is apparent in FIG. 2. In this exemplary embodiment, the conversion element 14 is designed as an eccentric element, in particular as an eccentric disk. The conversion element 14 is rotatable about a rotation point 15 and is driven by the single traversing drive 13, and so the conversion element 14 is set into the rotational movement ω.

The conversion element 14 interacts with at least one guide element 22*a*, 22*b* which is designed as two parallel guide edges in this exemplary embodiment. The conversion element 14 is guided between the guide elements 22*a*, 22*b*. Alternatively, the guide elements 22*a*, 22*b* can also be designed as a slot, for example. Due to the interaction between the conversion element 14 and the guide elements 22*a*, 22*b*, the holder 17 on the guide 16 is set into the traversing movement C, and so the yarn 3 is traversed along the axial direction X of the pair of delivery rollers 9, which is merely schematically represented here. The traversing movement C is oriented in parallel to the axial direction X of the pair of delivery rollers 9 in this case.

In the exemplary embodiment shown in FIG. 2, the yarn-guiding unit 12 is located in a middle position M. In the middle position M, the eccentric element faces the sensor 18 via its bulbous side, which is referred to here as the eccentric convexity 23. Alternatively, in the middle position M, the eccentric disk can also be situated so as to be rotated by 180°, and so, in the middle position, the thinner side of the eccentric element, which is referred to here as the eccentric back 24, faces the sensor 18.

In order to form the traversing movement C, for example, as shown in this exemplary embodiment, the conversion element 14, specifically the eccentric disk in this case, is rotated about the rotation point 15 with the aid of the single traversing drive 13 in the direction of rotation ω shown in FIG. 2. As a result, the eccentric convexity 23 is rotated in the direction of the guide element 22*a*. The eccentric back 24 is rotated in the direction of the guide element 22*b*, however. The eccentric convexity 23 presses the guide element 22*a* away in this case, and so the holder 17, including the yarn-guiding unit 12, moves to the left according to FIG. 2. When the eccentric disk has moved 90° further with respect to the orientation shown in FIG. 2 according to the direction of rotation ω, the maximum deflection of the holder 17 and of the yarn-guiding unit 12 toward the first side, specifically the left side in this case, has been reached. Upon further rotation of the eccentric disk, the holder 17 is moved back, specifically toward the right according to FIG. 2, until the eccentric convexity 23 has arrived at the guide element 22*b*. There, the holder 17 has the maximum deflection toward the right, according to FIG. 2. As a result, the traversing movement C can be formed in a single direction of rotation via a permanently rotating rotational movement of the single traversing drive 13. As a result, the single traversing drive 13 can be designed particularly simply and, therefore, a complicated control of the single traversing drive 13 is avoided.

In order to enable a position of the conversion element 14 to be detected, a sensor 18 is situated adjacent to the conversion element 14. The sensor 18 can be designed as a Hall sensor, in order to enable the position of the conversion element 14 to be contactlessly measured. For this purpose, the conversion element 14 includes a magnetic element 25 in the area of the eccentric convexity 23, which is utilized as a measuring point for the Hall sensor. The magnetic element 25 could also be provided in the area of the eccentric back 24 or even at any other point, of course. It is merely essential, during the installation of the traversing device, that the conversion element 14 and the yarn-guiding unit 12 are positioned with respect to each other in such a way that the magnetic element 25 faces the sensor 18 in the middle position of the yarn-guiding unit 12. Depending on the design of the sensor 18 and of the conversion element 14, it would also be conceivable that the sensor 18 merely detects the eccentric convexity 23 or back 24 as such or detects a special recess or any other characteristic feature of the conversion element 14.

The present invention is not limited to the exemplary embodiments which have been represented and described. Modifications within the scope of the claims are also possible, as is any combination of the features, even if they are represented and described in different exemplary embodiments.

LIST OF REFERENCE SIGNS

1 traversing unit
2 workstation
3 yarn
4 delivery unit
5 sliver
6 opening unit
7 fibers
8 rotor
9 pair of delivery rollers
10 bobbin
11 winding roller
12 yarn-guiding unit
13 single traversing drive
14 conversion element
15 rotation point
16 guide
17 holder
18 sensor
19 draw-off tube
20 cutting/blowing unit
21 measuring unit
22 guide element
23 eccentric convexity
24 eccentric back
25 magnetic element
C traversing movement
ω rotational movement
X axial direction
F flow direction of the yarn
M middle position

The invention claimed is:

1. A traversing unit for traversing a yarn with respect to a pair of delivery rollers of a workstation of a textile machine, comprising:
- a yarn-guiding unit;
- a single traversing drive at the workstation configured with the yarn-guiding unit, wherein each workstation of the textile machine has a respective single traversing drive;
- a conversion element configured with the single traversing drive such that a rotational movement (w) of the single traversing drive is converted into a linear, reciprocating movement of the yarn-guiding unit;
- the single traversing drive comprising a rotating motor; and
- a sensor disposed at the workstation to detect at least a middle position (M) of the yarn-guiding unit.

2. The traversing unit as in claim 1, wherein the conversion element comprises an eccentric element that interacts with a guide element provided on the yarn-guiding unit.

3. The traversing unit as in claim 2, wherein the guide element comprises two guide edges between which the eccentric element is guided.

4. The traversing unit as in claim 1, wherein the sensor is situated adjacent to the conversion element.

5. The traversing unit as in claim 4, wherein the sensor comprises a Hall sensor and the conversion element comprises a magnetic element.

6. A traversing unit for traversing a yarn with respect to a pair of delivery rollers of a workstation of a textile machine, comprising:
- a yarn-guiding unit;
- a single traversing drive configured with the yarn-guiding unit;
- a conversion element configured with the single traversing drive such that a rotational movement (w) of the single traversing drive is converted into a linear, reciprocating movement of the yarn-guiding unit;
- the single traversing drive comprising a rotating motor;
- a sensor disposed to detect at least a middle position (M) of the yarn-guiding unit; and
- wherein the yarn-guiding unit comprises one or both of a cutting unit and a blowing unit, with the aid of which the yarn can be cut in two or a yarn end can be blown into the workstation.

7. The traversing unit as in claim 1, wherein the yarn-guiding unit comprises a measuring unit, with the aid of which a condition of the yarn can be detected.

8. The traversing unit as in claim 1, wherein the single traversing drive is fixedly situated at the workstation, and the conversion element comprises an eccentric element that interacts with a guide element provided on the yarn-guiding unit, the guide element displaceable with respect to the workstation with the aid of the eccentric element.

9. The traversing unit as in claim 1, wherein one or both of the sensor and the conversion element are situated on the traversing unit such that an aligned position of the yarn-guiding unit with respect to a draw-off tube of the workstation is detectable.

10. A workstation of a textile machine, comprising a traversing unit according to claim 1.

11. A method for operating a traversing unit of a workstation of a textile machine, comprising:

guiding a moving yarn in a yarn-guiding unit of the traversing unit and moving the yarn-guiding unit linearly back and forth with a single traversing drive at the workstation and a conversion element to traverse the yarn with respect to a pair of delivery rollers, wherein each workstation of the textile machine has a respective single traversing drive;

operating the single traversing drive as a rotating motor; and detecting a middle position (M) of the yarn-guiding unit with the aid of a sensor.

12. A method for operating a traversing unit of a workstation of a textile machine, comprising:

guiding a moving yarn in a yarn-guiding unit of the traversing unit and moving the yarn-guiding unit linearly back and forth with a single traversing drive and a conversion element to traverse the yarn with respect to a pair of delivery rollers;

operating the single traversing drive as a rotating motor;

detecting a middle position (M) of the yarn-guiding unit with the aid of a sensor; and wherein during an interruption of the moving yarn, the yarn-guiding unit is positioned at the workstation such that the yarn-guiding unit is aligned with a draw-off tube of the workstation.

13. The method as in claim 11, further comprising detecting a position of the conversion element with the sensor in order to position the yarn-guiding unit on the workstation.

14. The method as in claim 11, further comprising driving the single traversing drive in accordance with a predefined speed profile.

* * * * *